United States Patent [19]

Maine et al.

[11] Patent Number: 4,760,390

[45] Date of Patent: Jul. 26, 1988

[54] GRAPHICS DISPLAY SYSTEM AND METHOD WITH ENHANCED INSTRUCTION DATA AND PROCESSING

[75] Inventors: Stephen Maine, Fort Salonga, N.Y.; Duncan Harrower, Fordingbridge, England; Abraham Mammen, Levittown, N.Y.

[73] Assignee: Computer Graphics Laboratories, Inc., New York, N.Y.

[21] Appl. No.: 705,367

[22] Filed: Feb. 25, 1985

[51] Int. Cl.[4] ..... G09G 1/16

[52] U.S. Cl. ..... 340/747; 340/725; 340/721; 340/798

[58] Field of Search ..... 340/729, 725, 801, 750, 340/748, 724, 726, 721, 747, 798, 799

[56] References Cited

U.S. PATENT DOCUMENTS

| | | | |
|---|---|---|---|
| 3,833,760 | 9/1974 | Tickle | 178/6.8 |
| 4,075,620 | 2/1978 | Passavaut et al. | 340/799 |
| 4,189,743 | 2/1980 | Schure et al. | 340/725 |
| 4,189,744 | 2/1980 | Stern | 340/725 |
| 4,209,832 | 6/1980 | Gilham et al. | 340/721 |
| 4,232,211 | 11/1980 | Agneta | 340/703 |
| 4,317,114 | 11/1982 | Walker | 340/721 |
| 4,384,338 | 5/1983 | Bennett | 340/729 |
| 4,404,554 | 9/1983 | Tweedy, Jr. et al. | 340/801 |
| 4,412,294 | 10/1983 | Watts et al. | 364/518 |
| 4,437,093 | 3/[illegible] | Bradley | 340/726 |
| 4,439,760 | 3/1[illegible]4 | Fleming | 340/799 |
| 4,459,677 | 7/1984 | Porter et al. | 364/900 |
| 4,554,538 | 11/1985 | Bieneman | 340/799 |
| 4,555,755 | 11/1985 | Pike | 364/900 |
| 4,611,202 | 9/1986 | DiNitto et al. | 340/724 |
| 4,700,181 | 10/1987 | Maine et al. | 340/747 |

FOREIGN PATENT DOCUMENTS

| | | |
|---|---|---|
| 60-302 | 12/1982 | European Pat. Off. . |
| 60117327 | 11/1983 | Japan . |

OTHER PUBLICATIONS

*Parallel Coprocessors Speed Graphics System*, 5/26/83, Electronic Design, McEwan pp. 129–135.

Wilkes et al., "The Rainbow Workstation", The Computer Journal, 1984.

Bell et al., "Graphics Controller Chip Does Windows, etc,", Electronic Design, Nov. 1985.

Intel Architectural Specification–82716/VSDD Video Storage and Display Device.

"Computer Graphics", Electronic Design, 1/20/83, p. 75 (introduction page for articles to follow).

(List continued on next page.)

*Primary Examiner*—Marshall M. Curtis

*Attorney, Agent, or Firm*—Martin M. Novack

[57] ABSTRACT

A system for the storage, retrieval and manipulation of significantly large amounts of data to produce highly complex and visually pleasing graphics within the time constraint of a full motion video raster scanning system by storing memory data corresponding to each of the individual object elements to be displayed over a period of time, storing lists of identification and display instruction data with respect to those object elements, selecting desired identification and display instruction data for selected display elements appropriate to a particular instant of time and placing such selected data into an appropriate memory, and then creating, from those selected instructions and from the stored data relating to the selected object elements, display data which, in real time, produces the desired display. The initially stored identification and display instructions are preferably in the form of a linked list with the items in each list arranged in order of desired visible priority. The display instructions can be effective to select for display from a given object element only predetermined sub-elements, and data can include animation instructions linked in order of time, preferably with linking both forward and backward in time. Data processing means can be effective to modify either or both types of stored memory data while a separte data processing means is engaged in producing the display data from the selected instructions and the object elements data stored in memory.

26 Claims, 5 Drawing Sheets

OTHER PUBLICATIONS

"Computer Graphics-Better Graphics Opens New Windows on CEA Stations", M. Schindler, Electronic Design, 1/20/83, pp. 77-82,84,86.

"Computer Graphics-Silicon Support For Video Displays Grows Smarter", D. Bursky, Electronic Design, 1/20/83, pp. 93-98.

"Computer Graphics-Graphics Standards are Emerging, Slowly but Surely", C. Bailey, Electronic Design, 1/20/83, pp. 103-110.

"Computer Graphics-Dedicated VLSI Chip Lightens Graphics Display Design Load", G. DePalma et al., Electronic Design, 1/20/83, pp. 131-136,138,139.

"Computer Graphics-uP Architecture Suits Bit--Mapped Graphics", P. Chu et al., Electronic Design, 1/20/83, pp. 143-148,150,152.

"Computer Graphics-CRT Controllers Chip Displays High Quality Attributes", B. Cayton et al., Electronic Design, 1/20/83, pp. 157-163.

"Computer Graphics-Graphics Frees Itself From Device Dependence", B. Perry, Electronic Design, 1/20/83, pp. 167-173.

"Computer Graphics-Focus on Graphics Terminals:V-LSI Raises Performance ", C. Warren, Electronic Design, 1/20/83, pp. 183,184,188-190,192.

B. Artwick, "Microcomputer Displays, etc", Prentice Hall, 1984, pp. 280-287.

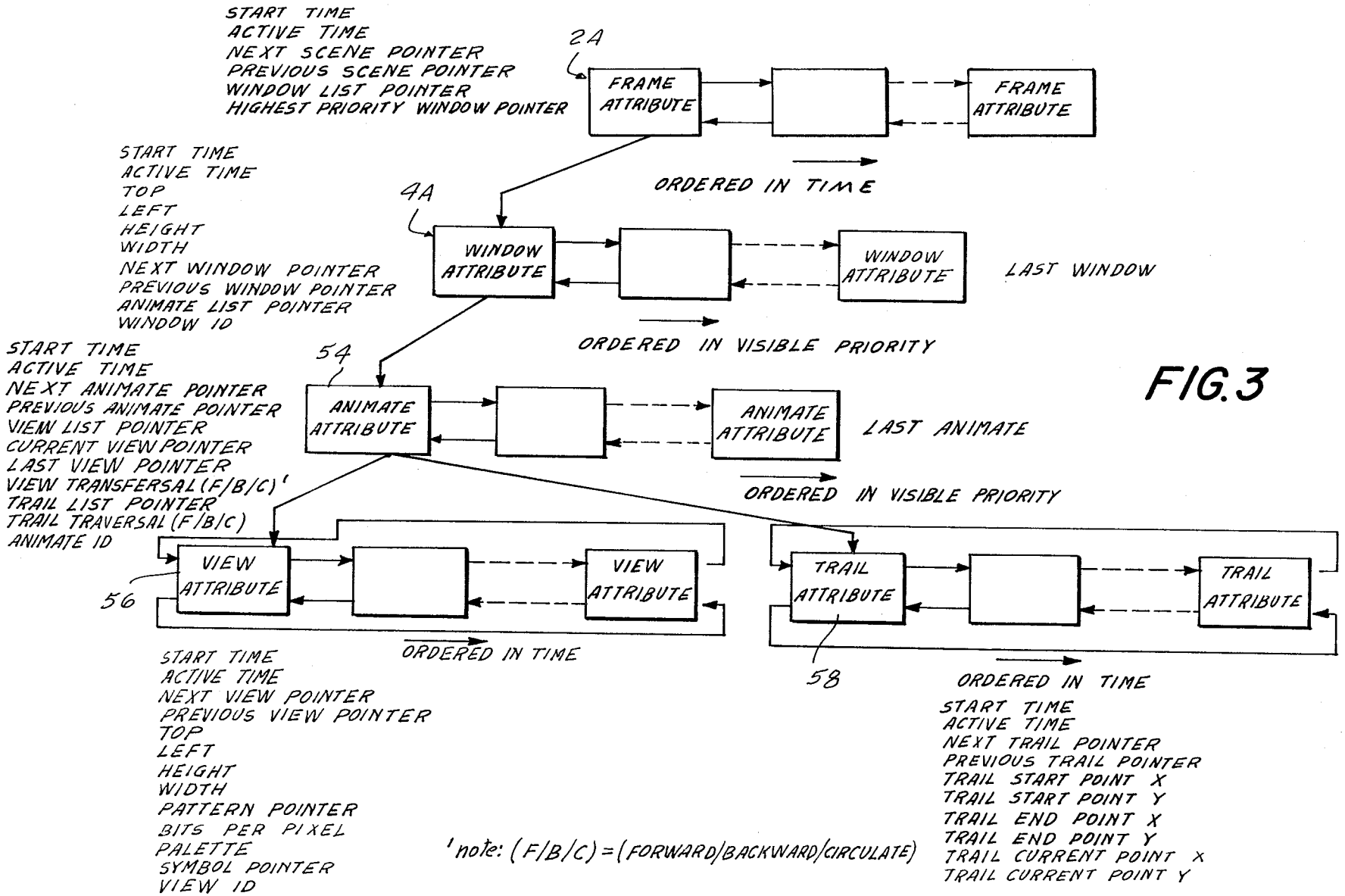
FIG. 3
FRAME ATTRIBUTE
FRAME ATTRIBUTE
24
START TIME
ACTIVE TIME
NEXT SCENE POINTER
PREVIOUS SCENE POINTER
WINDOW LIST POINTER
HIGHEST PRIORITY WINDOW POINTER
ORDERED IN TIME
WINDOW ATTRIBUTE
WINDOW ATTRIBUTE
4A
START TIME
ACTIVE TIME
TOP
LEFT
HEIGHT
WIDTH
NEXT WINDOW POINTER
PREVIOUS WINDOW POINTER
ANIMATE LIST POINTER
WINDOW ID
LAST WINDOW
ORDERED IN VISIBLE PRIORITY
ANIMATE ATTRIBUTE
ANIMATE ATTRIBUTE
54
START TIME
ACTIVE TIME
NEXT ANIMATE POINTER
PREVIOUS ANIMATE POINTER
VIEW LIST POINTER
CURRENT VIEW POINTER
LAST VIEW POINTER
VIEW TRANSFERSAL (F/B/C)'
TRAIL LIST POINTER
TRAIL TRAVERSAL (F/B/C)
ANIMATE ID
LAST ANIMATE
ORDERED IN VISIBLE PRIORITY
VIEW ATTRIBUTE
VIEW ATTRIBUTE
56
ORDERED IN TIME
START TIME
ACTIVE TIME
NEXT VIEW POINTER
PREVIOUS VIEW POINTER
TOP
LEFT
HEIGHT
WIDTH
PATTERN POINTER
BITS PER PIXEL
PALETTE
SYMBOL POINTER
VIEW ID
TRAIL ATTRIBUTE
TRAIL ATTRIBUTE
58
ORDERED IN TIME
START TIME
ACTIVE TIME
NEXT TRAIL POINTER
PREVIOUS TRAIL POINTER
TRAIL START POINT X
TRAIL START POINT Y
TRAIL END POINT X
TRAIL END POINT Y
TRAIL CURRENT POINT X
TRAIL CURRENT POINT Y
'note: (F/B/C) = (FORWARD/BACKWARD/CIRCULATE)

GRAPHICS DISPLAY SYSTEM AND METHOD WITH ENHANCED INSTRUCTION DATA AND PROCESSING

This invention relates to a novel method and apparatus for producing a video display of highly complex and visually pleasing graphics and for facilitating the manipulation of that display to produce animation.

Over the past two decades computers have been pervasive in penetrating many areas of industry, entertainment, defense and art. This increased use and acceptance of computers has generated a need for them to produce accurate and versatile results while at the same time being easy to operate by non-skilled users and involving the use of relatively simplified computer hardware. In no specific area has this need been more apparent than in connection with the production of computer graphics. In the past, images produced by reasonably priced computer systems were in general too crude to be useful in realistic imaging applications and current systems provide only limited animation capability.

A graphics display system which to a large extent satisfied that need is disclosed in our application Ser. No. 537,972 of Sept. 30, 1983 entitled "Graphics Display System" and assigned to the assignee of this application and here incorporated by reference. The general history of the art is set forth in that application under the heading "Background of the Invention". The system described in that application represented a significant advance over the prior art, particularly in the ability to select from vast amounts of data the information necessary to produce display images of desired precision and complexity, all within real time, but, as with any system, there was an upper limit on the amount of data which could be thus handled in real time.

There was therefore a strong incentive to produce a system which could further push forward the technology for producing quality display images, for expanding the amount of data which could be manipulated in real time to produce such images, and to further facilitate the ability to animate such images, all while still utilizing commercially practical computer hardware. The display system of the present invention is the result of that incentive. It utilizes many of the novel method and apparatus approaches of the aforementioned application Ser. No. 537,972, and in particular the features of storage of instructions in terms of linked lists, ways of choosing from a very extensive color pallette with only a minimal use of memory, the painting of individual object elements in the display in terms of relative visible priority, and the use of a pair of buffers which alternately function to receive data to be displayed and to produce the desired display, and an understanding of that prior system is desirable as a prerequisite to the appreciation of the advantages of the system here disclosed. Because the disclosure of said application Ser. No. 537,972 has been here incorporated by reference, those features will not be here explicitly described in detail.

The enhanced capability of the system of the present invention significantly expands the potentialities of a graphics system, including the system of the aforementioned patent application, particularly in terms of manipulation of data in order to create a scene and change it, all within the time constraint of a full motion video display system such as a CRT monitor or a TV set. As was the case with the system of the aforesaid earlier application, the computer graphics system of the present invention allows the user to manipulate complex realistic images in real time, but to do so with greater flexibility and precision than had previously been thought possible with any but the most complex and expensive computer systems. Such speed and resolution is derived from the way information is stored, retrieved and located.

As used in this specification and in the claims, "real time" refers to the time required by a full motion video display system, such as one meeting standards of the National Television Standards Committee, to provide commercially acceptable representations of motion. Typical of such display systems are CRT monitors, TV receivers and the like. The system of the present invention produces instant interactive images within the time required to scan a frame of the display system, and can sustain those images indefinitely. Thus, designed with speed in mind, this system is capable of producing life-like animation for domestic television set or monitors. This animation can be made up of entirely computer generated shapes or pictures scanned into the host computer with a video camera. In either case, the resolution provided is far better than what current low cost computer video systems provide.

It is therefore a prime object of the present invention to devise a system to store and handle more detailed data about a scene than has previously been thought practical and which minimizes the time required to retrieve that data and produce a picture.

It is another object of the present invention to devise a process and equipment to represent an image in storage and to facilitate the retrieving of a maximum amount of data in order to form an image of maximum datail, all in a minimum amount of time.

It is another object of the present invention to devise a method and apparatus which arranges graphics and data, and which retrieves that data, in a way to facilitate manipulation and animation of the produced images.

It is a further object of the present invention to enable stored data concerning an object element's appearance and/or instructions for the display thereof to be modified or changed in real time without interrupting the production of real time displays.

It is yet another object of the present invention to provide a system in which a very large amount of data is stored relating to the appearance of display objects and instructions as to the display thereof, only some of which objects are to be displayed at any given point in time, and enabling the display to be formed from selected object elements displayed in predetermined ways by a data processor which need not access all of the stored data in order to perform the task.

It is a still further object of the present invention to so design a display system that display object data and display instructions can be modified or augmented during, and without interrupting or delaying, the display process.

A key to the improved real time data handling capacity of the system of the present invention is the use of three memory components, preferably acted upon by two different data processing units. In a first memory component is stored the data corresponding to each of the object elements which might be displayed over a period of time. In the second memory component is stored, preferably in the form of a linked list in which the items are linked in order of desired visual priority, data comprising identification of particular object elements together with display instructions, e.g., the manner and location of representations of those object elements on the display to be produced. These first and second memory components are loaded with data from any suitable external source by means of a first data processing unit. The above describes a portion of the system of our earlier application. In this system there is a third memory component. The aforementioned data processing unit, acting in accordance with appropriate program instructions, selects from the second memory component those identifications and display instructions which are appropriate for the display that is to be produced at any given instant, and thus produces in said third memory component a compiled list, preferably but not necessarily sequential in character, of only those identifications and display instructions which are to be used at said particular instant to produce the display. When the display/construction buffers are of the line type, each compiled list will relate to a given line to be displayed at that particular moment. Stated more generally, each compiled list preferably relates to the content, for an instantaneous display, of the display/construction buffers then in use. This third memory component may be constituted by two alternatively acting sections, so that one can be used to produce a display while the other is being loaded with the appropriate data, just as the two display/construction line buffers of the system of our previous application (also preferably present in the system of this application) were alternately used. A second data processing unit, here often called a "painter", is instructed by the data in the third memory component to seek from the first memory component the data corresponding to a particular object element selected to be displayed and to put that data into the alternately acting display/construction buffer memories at the proper location and in the proper fashion, all as instructed by the data read from the third memory component. The display/construction buffer memories function, as disclosed in our earlier application, to produce the desired video display, including accurately producing the desired color at each point on the display.

The painter will access, in said third memory component, the data directly applicable to the particular display desired at a given instant in time, and need not access all of the identification and instruction data that is stored in the second memory in order to take care of all display eventualities. Hence highly sophisticated displays can be produced in real time. The time constraint of real time display production is in the amount of data that can be handled within that time. In the system of our earlier application, entire linked lists had to be traversed in real time, although only portions of those linked lists were relevant to the particular display that was to be produced at a given instant. In the system of the present invention, by way of contrast, the painter accesses only that data which the system has produced in the third memory component, and all or virtually all of that stored memory component data is relevant to the particular instantaneous display desired. Hence considerably more data which is actually display-productive can be handled by the system of the present invention than could be handled by the system of our earlier application.

While the construction/display buffers may if desired be formed on a line basis, the appropriate section or sections of the third memory component are loaded on the basis of a plurality of lines, and preferably on the basis of an entire field. Thus one has, for each of the sections of that third memory component, the complete field time (or plurality of lines time) in which to deposit the appropriate data from the first memory section, and the painter at any given instant need access only those parts of the appropriate section of the third memory component which contains data appropriate to the particular line or lines then being constructed by the painter in the construction/display buffer.

From a geographical point of view, the several components of the memory may exist in the form of separate cards or units, or they may be located in different dedicated areas of a single memory structure. It is sometimes desirable to integrate different portions of the various memory components, and particularly those portions of the second and third memory components which relate to one another. Thus the memory unit may consist of one geographical area defining the identification and display (second memory component) instructions for a first object element, directly adjacent thereto is an area dedicated to receiving the data for the third memory component relating to that object element, directly adjacent thereto is the second data component data for a second object element, directly adjacent thereto is the area dedicated to the third memory component data for that second object element, and so on.

It has been found desirable, when a given object element is made up of a plurality of sub-elements, to so structure the second memory component instructions as to enable the painter to select or "clip" from the data corresponding to a given object element only that data corresponding to one or more desired sub-elements. Thus even though the pattern memory for a given object element may comprise data representing a scene of appreciable width, a given instruction could cause the painter to take from that portion of the pattern memory only the data relating to a predetermined fraction of that scene, depending upon the particular view to be displayed.

The instructions in the second memory component may include animation instructions, identifying different views of a given object, all stored in the first memory component, which are to be displayed sequentially in point of time in order to produce an animation effect. Those instructions will preferably be in the form of linked lists in which the items are linked in terms of time sequence. When animation is desired the appropriate instructions can be deposited in the third memory component by the first data processor, and they then control the painter in constructing the data in the display/construction buffer memories.

In those linked lists, and in any other linked lists which may occur in the system, each item in the series desirably comprises linking instructions both forwards and backwards, so that each intermediate item of a given linked list is linked in both directions to adjacent items. This greatly facilitates the formation of identification and/or instructions in the third memory component where items are selected from only a portion of the items in a given linked list. The double linking speeds the location and utilization of desired data in the list, and hence facilitates display, and particularly animated display.

To the accomplishment of the above, and to such other objects as may hereinafter appear, the present invention relates to a system (method and apparatus) for forming a graphics display, as defined in the appended claims, and as described in this specification, taken together with the accompanying drawings, in which:

FIG. 3 is a view similar to FIG. 2 but showing an alternative, more complex arrangement in which animation instructions are included in the linked lists;

Figure 1:
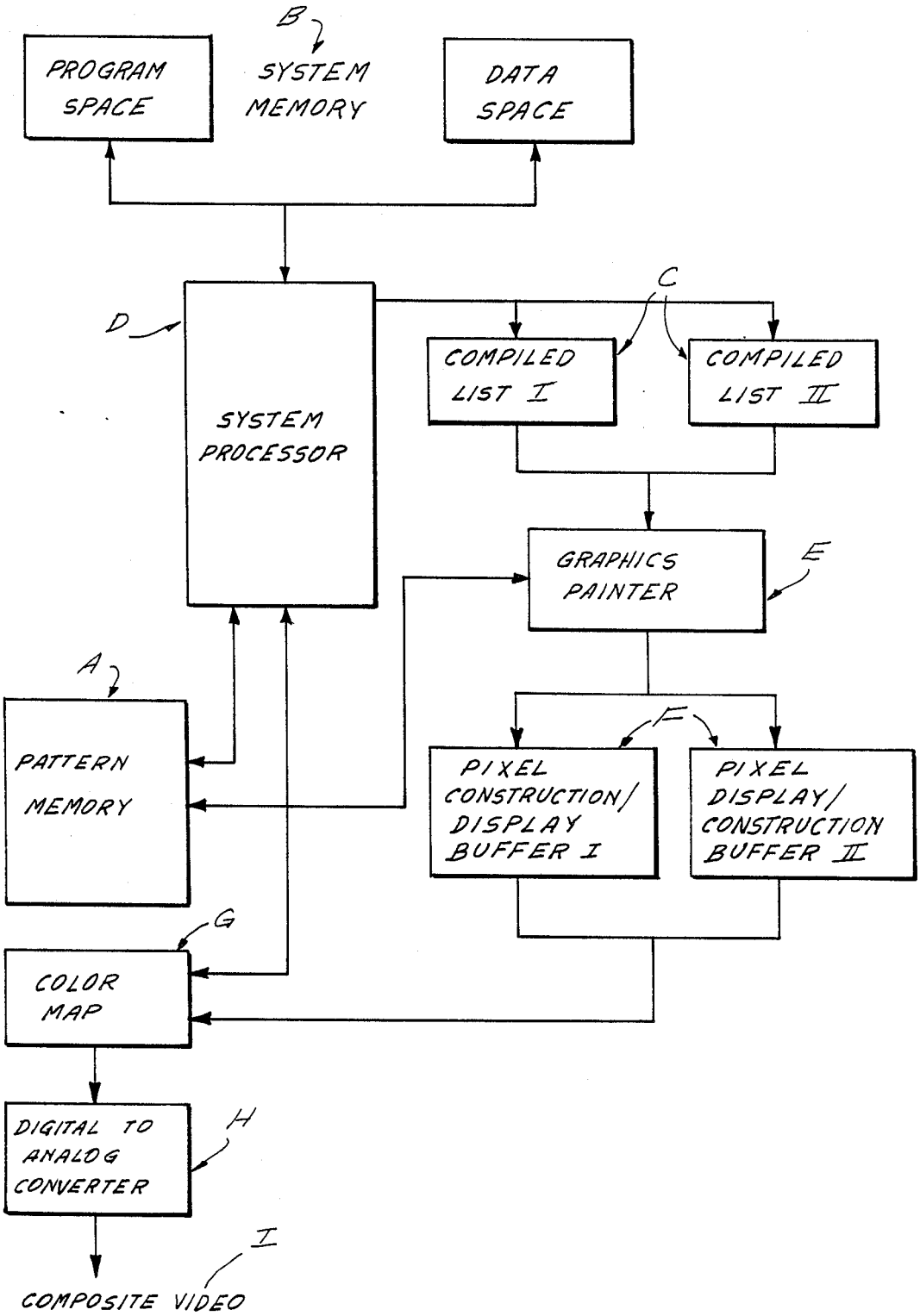
FIG. 1 is a block diagram of the system of the present invention.

The first memory component A, hereinafter termed "pattern memory", receives and stores data, usually in the form of a bit map, defining the appearance of those object elements which, it is expected, will be displayed over a period of time, although in most instances not all of those elements will be displayed at any given moment. An object element may be considered as an independent pictorial entity, which may in turn be made up of a plurality of sub-elements. The system of the present invention enables that object element, or "clip"-selected sub-elements thereof, to be freely positioned over the display space and to be unrestrictively overlaid over previous patterns placed in that display space. Such overlaying involves user-definable visible priority in terms of whether a given object element will appear in front of or behind another object element, thus enabling three-dimensional animation effects to be produced. Each individual object element is identified in some appropriate fashion, as by its location in that portion of the memory constituting the first memory component A. The pattern memory A forming a part of the display system may be augmented by memory structure external of the system proper, e.g., an attached disc storage instrumentality.

The second memory component B, hereinafter termed "system memory", may contain program instructions and will also contain data, preferably in the form of linked lists of the type generally described in our earlier application Ser. No. 537,972, identifying various components of a desired display and containing display instructions relative thereto, such as defining where on the screen the display of the object element is to be located, what its size is to be, what its color is to be and what, if any, manipulations (e.g. pan, zoom, warp, rotate) are to be performed on the relevant data stored in pattern memory A before that data is actually displayed. This data stored in the system memory B relates to all portions of the display which are to be formed throughout the period of operation of the system, and is not limited to the data needed for a display at any particular moment.

A data processing unit, generally designated D, and hereinafter termed the "system processor", functions before a display run is commenced to deposit the appropriate data in the pattern memory A and the system memory B, obtaining that data from some external source, and the system processor D may also be used to update the data in pattern memory A and/or system memory B, in accordance with instructions and data either internally stored or received from an external host computer, while the system is operating to produce displays. It further loads color information into a color map memory G.

In accordance with the present invention, the system processor D performs an additional function. As display time passes it reads from the linked lists of system memory B that identification and display instruction data relevant to creating a display at a particular moment, and it deposits that data into the third memory component C. That which is deposited will hereafter be termed "the compiled list", which may well be in the form of a sequential list, and hence the memory component C will hereinafter be termed the compiled list memory C. The compiled list represents the object element identification and relevant display instructions for a particular instantaneous display, this being usually only a small proportion of the corresponding data stored in the system memories A and B.

A separate data processing unit generally designated E, and hereinafter termed the "graphics painter", addresses the identification and instruction data stored at any given moment in the compiled list C and, for each object element identified in the compiled list C, reads from the pattern memory A the data defining the appearance of that object element and then, in accordance with the display instructions for that object element stored in the compiled list C, the graphics painter E produces display data which it feeds to the two alternately acting display/construction buffers generally designated FI and FII which, as here specifically disclosed, correspond to the alternately acting buffers 16 and 18 of our prior application Ser. No. 537,972. The two display/construction buffers FI and FII are here disclosed as constructing lines of the display, one such buffer being constructed by having data put thereinto by the graphics painter E while the other such buffer is acting to produce a line display, the functions of the two buffers FI and FII alternating in time. Hence the graphics painter E may access the system memory B and the pattern memory A on a line-by-line basis.

As in our prior application, the output from the construction/display buffers F goes to the color map G, into which appropriate data had previously been stored by the system processor D, and from there the display data goes to digital to analog converter H, from which a composite video signal I system goes to the display instrumentality, all in well known manner and, for example, as described more in detail in our prior application.

It is desirable that the system processor D, in response to information received from outside the system or from the program in system memory B, modify the linked lists in the system memory B in real time without affecting the capability of the system to produce real time displays. To that end we provide two compiled lists C-I and C-II, each of which may contain the appropriate identification and display instruction data for a given frame. When one of the compiled lists C-I or C-II is being accessed by the graphics painter E in order to produce display data, the other compiled list C-II or C-I is being constructed by the system processor D.

As has been explained, the data in the compiled list C comprises the identification and display instructions relating to the visible objects in the scene to be displayed at a given moment. In order to have those displayed objects be of adequate resolution, detail and color, and to simultaneously display a significant number of different objects, the amount of data required for the compiled list C cannot, as a practical matter, be generated in line time, yet each of the construction/display buffers F are constructed in line time. But since the compiled list C relates to an entire frame, that list can be generated in frame time, and since typically there are 525 lines to a frame in a conventional TV display, that gives 525 times more time for compiled list construction than for line buffer construction when the display is to be changed thirty times a second (the time to display a given frame), thus enabling the system to handle significantly more data than previous systems and thus produce considerably more sophisticated displays. If the display need not be changed so frequently, there is a corresponding increase in the time available to generate a given compiled list.

For all of these reasons the system processor D can handle much more data in real time than was possible in the system of our previous application.

Figure 2:
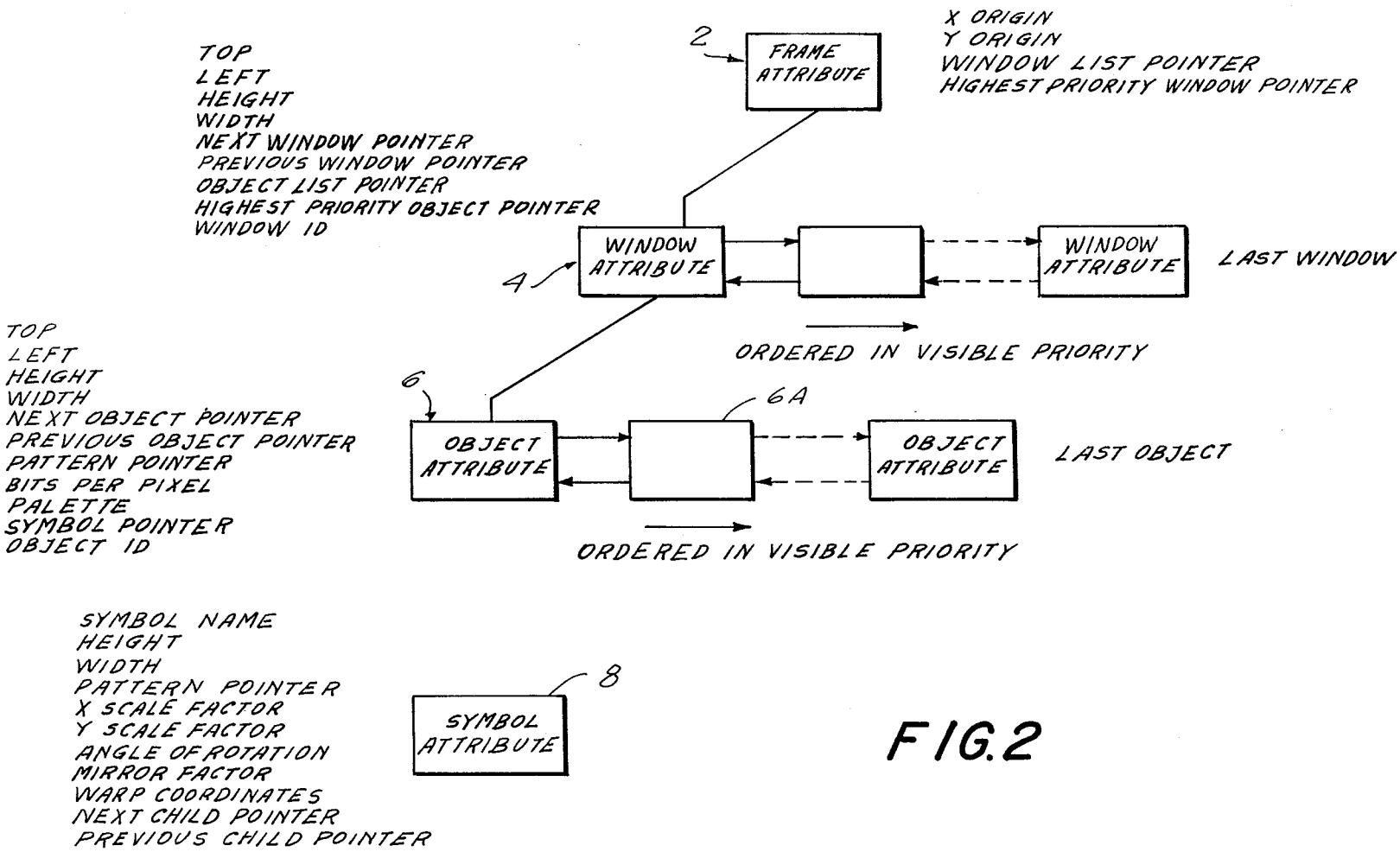
FIG. 2 is a "tree" diagram illustrating a typical linked list arrangement of data comprising display element identification and display instructions, together with indications of the details of typical data categories for each of the unit blocks.

FIG. 2 represents a typical linked list arrangement of object element identification and display data stored in the system memory B. Data is there stored in a hierarchy of attributes, with some or all of those attributes being further arranged in the form of linked lists ordered in terms of visible priority. For example, and as shown in FIG. 2, the highest or most general attribute is the frame attribute 2, next in order are the window attributes 4, and, for each window attribute 4, the various object attributes 6 associated therewith. In addition, and for purposes of enabling access to particular objects or lists, a series of symbol attributes 8 may be stored, each of which may also include a list of sub-identifications (called "children"), e.g., "dog" may be the main symbol and "dog walking", "dog sitting", "dog jumping" etc., may be "children".

The data stored for the frame attribute 2, which represents an overall scene to be displayed at a given moment, comprises its desired x and y origin points on the display screen, a pointer to the window list or lists that are to be used in that frame, and an identification of the highest priority window in that window list which is to be used.

A "window", as here used, is a defined viewpoint, or rectangle through which selected object elements are to be viewed, the window itself defining the bounds of the viewing area and hence determining what portion of the selected object element is to be displayed. Each window attribute 4 contains data defining its desired location on the display, its size, linking pointers, preferably to both the preceding as well as the succeeding window in the linked list, a pointer to the object list or lists to be included in the window, a pointer to the highest priority object in that list which is to be displayed, and an identification of the window to match with the appropriate symbol attribute 8.

Each object attribute 6 includes a pointer to pattern memory A, identifying the pictorial data in that pattern memory A which relates to the particular object, the desired location of the object, its size, a definition of the number of bits per display pixel, identification of the color palette to be used, and identification of the symbol attribute 8 that is to correspond to that object, as well as data identifying the object itself. Each symbol attribute 8 may contain data defining an identifying name, so that it can be manually or automatically selected, together with data concerning its size, its location in the pattern memory A and, if desired, data concerning various manipulations which might be performed to controllably modify or distort the display image as well as links, preferably in both directions, to the allied "children" data.

It has been found to be advantageous to also include in the object attribute 6 data restricting the portion of the relevant display object which is to be displayed. This data can be in the form of words identifying the location of the top, left-hand side, bottom and right-hand side of the area to be clipped and, if a particular object within a composite object element is fractured by the clip, additional words defining the overall clip conditions with respect to that object. The clip in effect constitutes a restricted area of observation within that portion of the window of which the clip may be a part. Hence only that portion of the object element will be displayed which is both within the window attribute 4 definition and the clip instructions definition. When a clipping is to be accomplished the relevant clip data is added to the object attribute data shown in FIG. 2.

Figure 4:
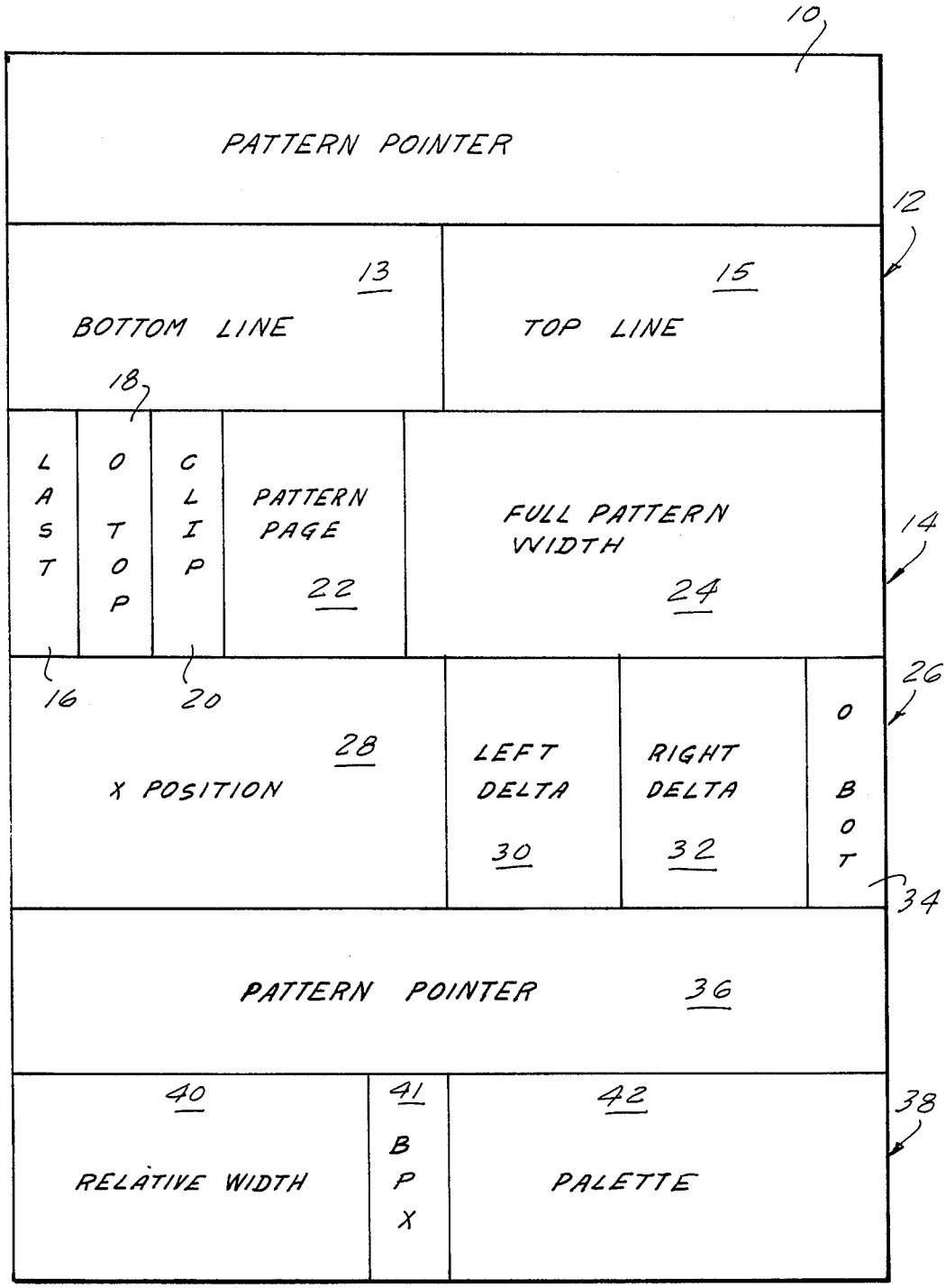
FIG. 4 is a diagram showing a typical way in which individual data items may be included and arranged in the compiled list of the third memory component.

What the system processor D does during the display process is to read the appropriate lists in system memory B, such as the one disclosed in FIG. 2, and produce, for each object element to be displayed at that point in time, data in the compiled list C. FIG. 4 is a representation of a particular body of data relating to a particular display object as it may be produced and temporarily stored in a compiled list C. The first line 10 of that data is a pointer to pattern memory A identifying the particular line of that pattern memory to which the painter E should go. That line typically comprises four bytes of eight bits each. It usually takes more than one line of pattern memory to create one display line of the object, and therefore the compiled list for a given line of an object may require sequential reference to a plurality of pattern memory lines. In such a case the data in line 10 initially points to the line in memory where the picture is to start. The "bottom line" and "top line" units 13 and 15 in line 12 indicate the position that the object should assume on the display screen. Each requires nine bits, but the memory is only sixteen bits wide. Therefore the "0 top" and "0 bottom" units in lines 14 and 17 respectively represent the ninth needed bit in the top and bottom line items 13 and 15 respectively. In line 14 the "last" item 16 is a flag which appears only when the data block is used for the last time in a sequence. The "clip" item 20 is a flag indicating whether or not a clip is involved. The "pattern page" item 22 is used in con3unction with pattern pointer 10 in order to direct the painter E to the right spot in memory. The "full pattern width" item 24 in line 14 and the "relative width" item 40 in line 38 represent respectively an indication of the number of pixels which make up the entire object line and the number of pixels needed to make up the object line taking into consideration the proportion of the entire object to be displayed. The "X position" item 28 in line 17 identifies the desired horizontal position where the display of the object element should start. The "left delta" and "right delta" units 30 and 32 are used when, because of clip or window constraints, not all of a given line in memory is to be used in painting the line of the picture. The second "pattern pointer" unit in line 36 identifies the first line of the relevant data in the pattern memory A. When, as has been explained, it is necessary to read more than one line of pattern memory in order to create a given display line, the first pattern pointer 10 and the second pattern pointer 36 are initially the same but, as the compiled list is followed and the painter E is directed to different lines in memory for a given object element, the first pattern pointer unit 10 points to those lines sequentially, being changed by the value of full pattern width 24 each time the data structure is run through and the object or portion thereof is to be displayed. The second "pattern pointer" unit 36, which remains constant, is used to return the first "pattern pointer" unit 10 to its initial value after the last sequence has been carried out. In line 38 the data unit 41 identifies the number of bits per pixel to be employed in making the display, and the "palette" unit 42 identifies the particular color that is to be used in displaying that particular portion of the object element.

It is to the data blocks of the type shown in FIG. 4 that the graphics painter E goes to determine where in pattern memory A it should look and what it should do with what it finds at the identified location in pattern memory A. It then deposits the relevant information, which we now call "display data" because it is the data actually to be used to produce a particular display image, into the construction/display buffers F in line basis real time, the system then functioning essentially as described in our earlier application in order to produce the display image.

Figure 5:
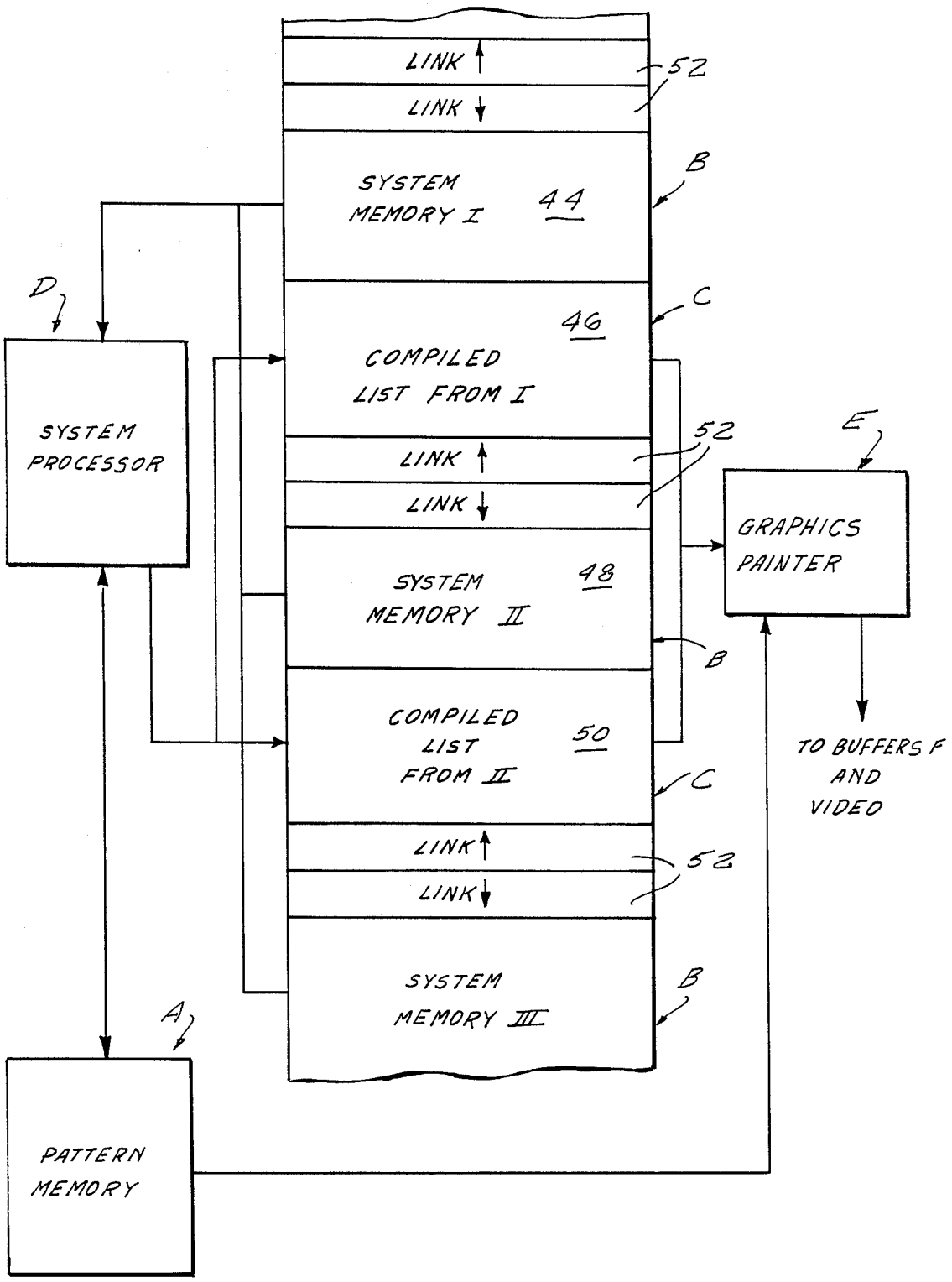
FIG. 5 is a combination of a block diagram and a representation of one particular geographical arrangement of portions of the second and third memory components generally designated A, B and C.

All of the compiled list data such as is exemplified by FIG. 4 may be deposited in an area or unit of memory dedicated to that purpose, but this is not essential. The compiled list data may, from a physical or geographical viewpoint, be integrated with the linked list data of the system memory B. This is schematically indicated in FIG. 5, where a given unit 44 from system memory B, such as a particular object attribute 6, is immediately followed geographically by that portion 46 of the compiled list C which has been created by the system processor D in accordance with that particular object attribute 6. Next in line, at area 48, may be the next object attribute 6A in a given linked list of object attributes (see FIG. 2), followed at 50 by the compiled list formed by the system processor D in accordance with that object attribute 6A, and so on, the links 52 of the object attribute linked list being located as disclosed, it being noted that those links operate in both directions so as to link a given object attribute 6 with both the preceding object attribute and the succeeding object attribute in a given linked list. The systems memory data in areas 44 and 48 will normally remain in the course of the display, unless changed by the system processor D in accordance with appropriate commands, either external or from the program portion of system memory B, but the compiled list data in areas 46 and 50 will be constantly changed during the display, as above described.

FIG. 3 is a block diagram of the same general character as FIG. 2 but showing a typical arrangement of linked lists and the data involved in those linked lists where animation instructions are integrated with the identification and other display instructions of the linked list system of FIG. 2. In FIG. 3 there is a first linked list 2A of frame attributes linked in terms of time because of the animation, each of the attributes thereof pointing to one or more linked lists 4A of window attributes. The system of FIG. 3 contains, for each window attribute 4A, one or more lists 54 of animation attributes, linked in order of visual priority, each of which in turn points to one or more linked lists 56 of view attributes and one or more linked lists 58 of trail attributes. The view attributes 56 correspond generally to the object attributes 6 of the system of FIG. 2, except that the view attributes of a given linked list 56 represent views of the same object different from one another in a manner such as to produce an animation effect when sequentially displayed. Hence the view attributes in a given linked list 56 are ordered in time (visual priority is controlled by the linking in the animation attributes list 54). The trail attributes of linked list 58, also ordered in time, control the sequence of different physical locations where the individual view attribute objects are displayed, thus causing the objects to traverse a specified route on the display screen. The animation attributes give instructions as to how the view attribute linked list 56 and trail attribute linked list 58 are to be traversed (forward, backward or in circulatory fashion, sequentially or by skipping individual views). When a particular animation attribute 54, at a given point in time, activates a particular view attribute 56 and trail attribute 58, the graphics painter E will be apprised, by the pattern pointer in the operative view attribute item 56 and by the bits per pixel and palette data also there included, what particular object should be read from the pattern memory A, how long it should remain on the screen, and how it should be displayed on the screen.

The double linking of the individual attributes in the linked lists of FIGS. 2 and 3, in which each intermediate item in the linked list has link instructions forward and backward to the item immediately after it and the item immediately before it, greatly facilitates modifying those linked lists in accordance with instructions received from the system processor D, as by adding or deleting items. With such double linking it is not necessary, in order to make an insertion, to start from the beginning of the list to find the proper place where the insertion of the new item is to take place. The system processor D can go directly to the place where the item is to be inserted and insert it without having to modify the linking instructions of any of the objects in the list except for the two items immediately before and immediately after the item inserted. It further greatly facilitates the making of directional changes forward or backwards on the transversal of the list, something that is very important when animation of the type disclosed in FIG. 3 is involved. For example, if we want to show smooth motion we may use twenty sequential images, but if we want to show rough motion or faster motion we may wish to delete every other one of those twenty images to produce a list of ten images. That can be done much more quickly with double linking than if the system has to search out the proper point for each deletion by counting again from the beginning in each instance.

Through the use of the data handling and manipulating system above described, display images can be formed by means of practical and relatively inexpensive hardware in real time which are of significantly greater complexity, precision and resolution than has heretofore been possible. While particular embodiments of the present invention have been here specifically disclosed, it will be apparent that many variations may be made therein, all within the spirit of the invention and defined in the following claims.

We claim:

1. A method for creating on a display screen of a CRT monitor, TV receiver or the like a representation of a scene comprising selected ones of a plurality of object elements, said method comprising A. storing first memory data corresponding to said plurality of object elements;

B. storing second memory data identifying object elements together with instructions as to the manner and location of representations of said object elements or parts thereof;

C. creating, from said second memory data, third memory data corresponding to identification and instructions with respect to selected ones of the object elements to be displayed;

D. creating, from said first memory data and in conformity with the identification and instructions of said third memory data, display data for said selected object elements;

E. causing the display data of step D to produce a display on said screen;

F. at least said steps D and E being carried out in real time relative to the scanning time of said monitor, receiver or the like.

2. A method for creating on a display screen of a CRT monitor, TV receiver or the like a representation of a scene comprising selected ones of a plurality of object elements, said method comprising A. storing first memory data corresponding to said plurality of object elements;

B. storing second memory data identifying object elements together with instructions as to the manner and location of representations of said object elements or parts thereof, said second memory data being stored in the form of linked lists in which the order of said data corresponds to the desired visible priority of said object elements;

C. creating, from said second memory data, third memory data corresponding to identification and instructions with respect to selected ones of the object elements to be displayed;

D. creating, from said first memory data and in conformity with the identification and instructions of said third memory data, display data for said selected object elements;

E. causing the display data of step D to produce a display on said screen;

F. at least steps D and E being carried out in real time relative to the scanning time of said monitor, reciever or the like.

3. The method of claim 1, in which step C and step D are carried out simultaneously by differnet processing means.

4. The method of claim 2, in which step C and step D are carried out simultaneously by different processing means.

5. The method of any of claims 1–4, in which said monitor representation comprises a field made up fo a series of lines, and in which steps D and E are carried out in real time relative to the scanning time of fewer than all of the lines of said field.

6. The method of any of claims 1–4, in which said monitor representation comprises a field made up of a series of lines, and in which steps D and E are carried out in real time relative to the scanning time of fewer than all of the lines of said field and step C is carried out in real time relative to the scanning time of said field.

7. The method of any of claims 1 or 2, in which, when a preselected fraction of a given object element is to be displayed, step C identifies that preselected fraction and step D creates said display data for said object element which includes only the data corresponding to said preselected fraction.

8. The method of any of claims 1–4, in which said third memory data for each of said object elements are physically located so as to sequentially follow said second memory data for the corresponding object elements.

9. The method of any of claims 1–4, in which said second memory data comprises a series of data ordered in time to identify a series of object elements representing animation of a selected object element, and causing said display data at any point in time to include data from said series of data corresponding only to that point in time.

10. The method of claim 9, in which said data ordered in time is in the form of a linked list comprising a plurality of items in which each intermediate item is linked in both directions to adjacent items.

11. The method of claim 9, in which step D creates display data which includes the appropriate data as a result of instructions forming a part of said second memory data and created in said third memory data.

12. The method of claim 11, in which said data ordered in time is in the form of a linked list comprising a plurality of items in which each intermediate item is linked in both directions to adjacent items.

13. Apparatus for creating on a display screen of a CRT monitor, TV receiver or the like a representation of a scene comprising selected ones of a plurality of object elements, said apparatus comprising A. a pattern memory for storing data representing a plurality of object elements;

B. a system memory for storing data identifying object elements and data comprising instructions defining the nature and location of representations of said object elements or parts thereof;

C. a third memory for storing instructions as to the identify, nature and location of display of selected ones of said objecct elements;

D. a buffer memory for storing data corresponding to the desired representation of at least a portion of said scene;

E. first data processing means operatively connected between said system memory for transforming data therebetween;

F. second data processing means operatively connected between said third memory, said pattern memory and said buffer memory for depositing in said buffer memory data from said pattern memory in response to instructions from said third memory; and G. display means for causing said data in said buffer memory to produce a display on said screen corresponding to said desired representation.

14. In the apparatus of claim 13, means enabling said first and second data processing means to function simultaneously and independently.

15. The apparatus of claim 13, in which said data in said system memory is stored in the form of linked lists with data linked in the order of their desired visible priority.

16. In the apparatus of claim 15, means enabling said first and second data processing means to function simultaneously and independently.

17. The apparatus of any of claims 13–16, in which, when a preselected fraction of a given object element is to be displayed, said system memory contains instructions identifying that preselected fraction and said second data processing means deposits in said buffer memory, for said given object element, only the data relating to said predetermined fraction thereof.

18. In the apparatus of any of claims 13–16, animation means comprising data in said system memory comprising, for a given object element, a series of data ordered in time to represent animation of said given object element, said second data processing means at a given point in time depositing in said buffer memory data from said pattern memory corresponding to said animation data for said given point in time.

19. In the apparatus of any of claims 13–16, animation means comprising data in said system memory comprising, for a given object element, a series of data ordered in time to represent animation of said given object element, said second data processing means at a given point in time depositing in said buffer memory data from said pattern memory corresponding to said animation data for said given point in time, in which said series of data is in the form of a linked list comprising a plurality of items in which each intermediate item is linked in both directions to adjacent items.

20. In the apparatus of any of claims 13–16, animation means comprising data in said system memory comprising, for a given object element, a series of data ordered in time to represent animation of said given object element, said second data processing means at a given point in time depositing in said buffer memory data from said pattern memory corresponding to said animation data for said given point in time, in which said animation means comprises A. in said system memory (1) a linked list of animation instructions, (2) a linked list of identification of different object views stored in said pattern memory, and (3) a linked list of instructions for movement in time, individual (1) items being controllingly connected to (2) and (3) items, and B. means for enabling said (1) items, when selected, to control the selection and transmission of individual (2) items in accordance with selected timed instructions from said (3) items.

21. The apparatus of claim 20, in which said (1) items are linked in order of desired visible priority and said (2) and (3) items are linked in order of time.

22. The apparatus of claim 20, in which each intermediate item of a given linked list is linked in both directions to adjacent items.

23. The apparatus of claim 21, in which each intermediate item of a given linked list is linked in both directions to adjacent items.

24. The apparatus of claim 18, in which, when a preselected fraction of a given object element is to be displayed, said system memory contains instructions identifying that preselected fraction and said second data processing means deposits in said buffer memory, for said given object element, only the data relating to said predetermined fraction thereof.

25. The method as defined by claim 2, in which said third meory data is stored in the form of at least one linked list complied from said second memory data.

26. The method as defined by claim 15, in which said third memory data is stored in the form of at least one linked list compiled from said second memory data.

* * * * *